US006887131B2

(12) United States Patent
Jiang et al.

(10) Patent No.: US 6,887,131 B2
(45) Date of Patent: May 3, 2005

(54) POLISHING PAD DESIGN

(75) Inventors: Lei Jiang, Aloha, OR (US); Sadasivan Shankar, Cupertino, CA (US); Paul Fischer, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/228,094

(22) Filed: Aug. 27, 2002

(65) Prior Publication Data

US 2004/0043698 A1 Mar. 4, 2004

(51) Int. Cl.[7] ..... B24B 9/00
(52) U.S. Cl. ..... 451/28; 451/54; 451/41
(58) Field of Search ..... 451/41, 285, 287, 451/288, 527, 533, 54, 28

(56) References Cited

U.S. PATENT DOCUMENTS

| | | | | |
|---|---|---|---|---|
| 5,177,908 A | | 1/1993 | Tuttle | |
| 5,216,843 A | | 6/1993 | Breivogel et al. | |
| 5,246,884 A | * | 9/1993 | Jaso et al. | 437/225 |
| 5,396,737 A | | 3/1995 | Englund et al. | |
| 5,441,598 A | | 8/1995 | Yu et al. | |
| 5,489,233 A | | 2/1996 | Cook et al. | |
| 5,595,526 A | | 1/1997 | Yau et al. | |
| 5,821,164 A | * | 10/1998 | Kim et al. | 438/633 |
| 6,034,434 A | * | 3/2000 | Bothra et al. | 257/758 |
| 6,169,931 B1 | | 1/2001 | Runnels | |
| 6,358,853 B2 | | 3/2002 | Cadian et al. | |
| 6,439,986 B1 | * | 8/2002 | Myoung et al. | 451/443 |

OTHER PUBLICATIONS

Lei Jiang et al., "Fluid and Contact Mechanics Modeling of Chemical–Mechanical Polishing", (six unnumbered pages), presented at VMIC conference in 1999.

Lei Jiang et al., "Multi–Scale Modeling of Flow and Mass–Transfer in Chemical Mechanical Polishing" (eleven unnumbered pages), Electrochemical Society CMP Int. Symposium 2000.

Michael A. Fury, *Solid State Technology* "Emerging developments in CMP for semiconductor planarization" pp. 47–54, Apr. 1995.

Igbal Ali, *Solid State Technology* "Pad conditioning in interlayer dielectric CMP", pp. 185–191, Jun. 1997.

Cook et al., Abstract of "Theoretical and Practical Aspects of Dielectric and Metal CMP" from Semiconductor International, vol. 18, No. 13, Nov. 1995.

* cited by examiner

*Primary Examiner*—Eileen P. Morgan
(74) *Attorney, Agent, or Firm*—Jay P. Beale

(57) ABSTRACT

A method is provided for creating a polish pad. This may involve determining a design layout of a wafer. The design layout may include a distribution of metal line features on the wafer. A polish pad design may be created/determined based on the determined layer. The polish pad may have asperities having a width greater than a width of metal line features of the wafer.

7 Claims, 8 Drawing Sheets

POLISHING PAD DESIGN

FIELD

The present invention is directed to the field of semiconductor processing. More particularly, the present invention is directed to the field of polishing methods and apparatuses for providing films over a semiconductor substrate.

BACKGROUND

Integrated circuit (IC) devices may rely upon an elaborate system of conductive interconnects for wiring together transistors, resistors, and other IC components, which are formed on a semiconductor substrate. The technology for forming these interconnects is highly sophisticated and well understood by practitioners skilled in the art. In a typical IC device manufacturing process, many layers of interconnects are formed over a semiconductor substrate, each layer being electrically insulated from adjacent layers by an interposing dielectric layer. The surface of these interposing dielectric layers should be as flat, or planar as possible to avoid problems associated with optical imaging and step coverage, which could frustrate the proper formation and performance of the interconnects.

As a result, many planarization technologies have evolved to support the IC device manufacturing industry. One such technology is called chemical mechanical polishing or planarization (CMP). CMP may include the use of lapping machines and other chemical mechanical planarization processes to smooth the surface of a layer, such as a dielectric layer, to form a planar surface. This may be achieved by rubbing the surface with an abrasive material, such as a polish pad, to physically etch away rough features of the surface. Rubbing of the surface may be performed in the presence of certain chemicals that may be capable of chemically etching the surface as well. After a dielectric layer has been sufficiently smoothed using CMP, interconnects may be accurately and reliably formed on the resulting planar surface.

Metal CMP, such as copper (Cu) CMP, is one step in the damascene technology for sub-micron processes. Significant copper dishing and recessing (such as within an interlayer dielectric) may occur as a result of a combined effect of chemical and mechanical actions that lead to a larger copper etch rate as compared with a barrier layer etch rate (and oxide etch rate) on patterned wafers. Thus, metal features (such as interconnect lines) may be polished faster than other surfaces, leading to recessed and dished structures. At the same time, protruded oxide and interlayer dielectric (ILD) patterns may suffer from excessive stress and a larger polish rate, which may lead to erosion. Combined copper dishing, recess and oxide erosion may lead to overall resistance variation within the die and within the wafer, and possibly yield degradation either by dishing/erosion related metal CMP defects or by build-up of uneven topography over metal layers. Therefore, dishing and erosion is an issue in CMP processes.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example arrangements and embodiments of the invention, it should be clearly understood that the same is by way of illustration and example only and that the invention is not limited thereto.

The following represents brief descriptions of the drawings in which like reference numerals represent like elements and wherein.

DETAILED DESCRIPTION

Figure 1A:
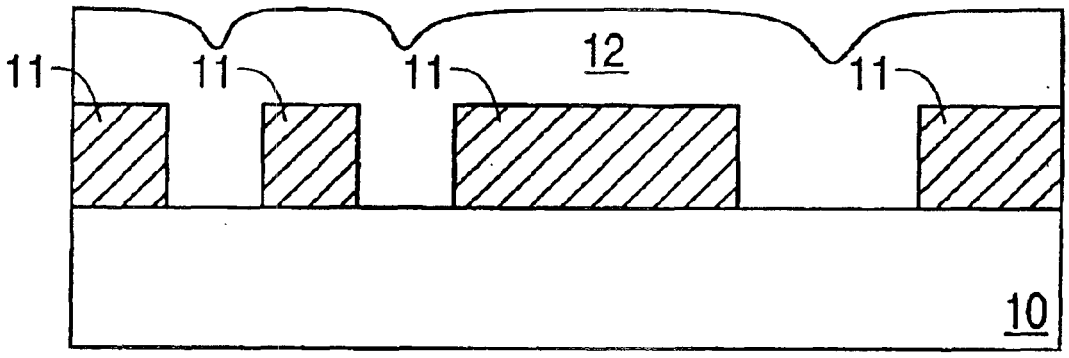
FIG. 1A illustrates a cross sectional view of a semiconductor substrate showing interconnects and a dielectric layer.

In the following detailed description, like reference numerals and characters may be used to designate identical, corresponding or similar components in differing figure drawings. Further, in the detailed description to follow, example values may be given, although the present invention is not limited to the same.

Figure 1B:
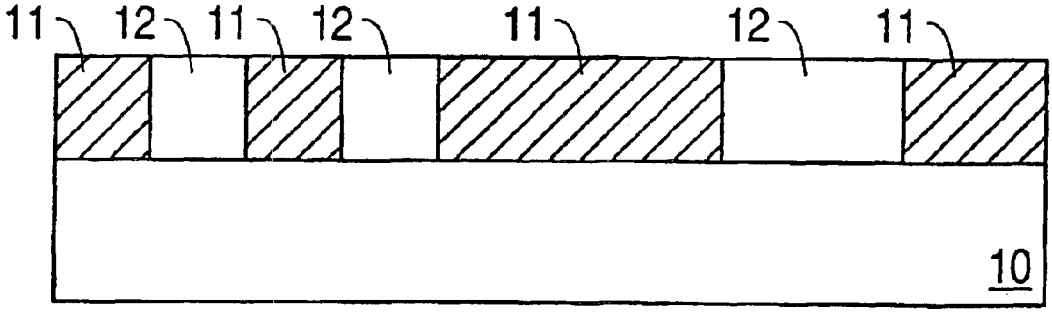
FIG. 1B illustrates a cross sectional view of the substrate of FIG. 1A after the dielectric layer has been polished.

FIG. 1A illustrates a semiconductor substrate 10 upon which a layer of interconnects 11 has been formed according to one arrangement. Other arrangements are also possible. A dielectric layer 12 is deposited over the surface of the interconnects 11. The surface of the dielectric layer 12 may conform to the underlying topography of the interconnects 11, resulting in the illustrated non-planar surface. FIG. 1B illustrates the substrate of FIG. 1A after a CMP process is used to polish back the surface of the dielectric layer 12 to the surface of the interconnects 11, planarizing the substrate. Another dielectric layer may be deposited on the flat surface of the substrate in FIG. 1B.

Figure 2:
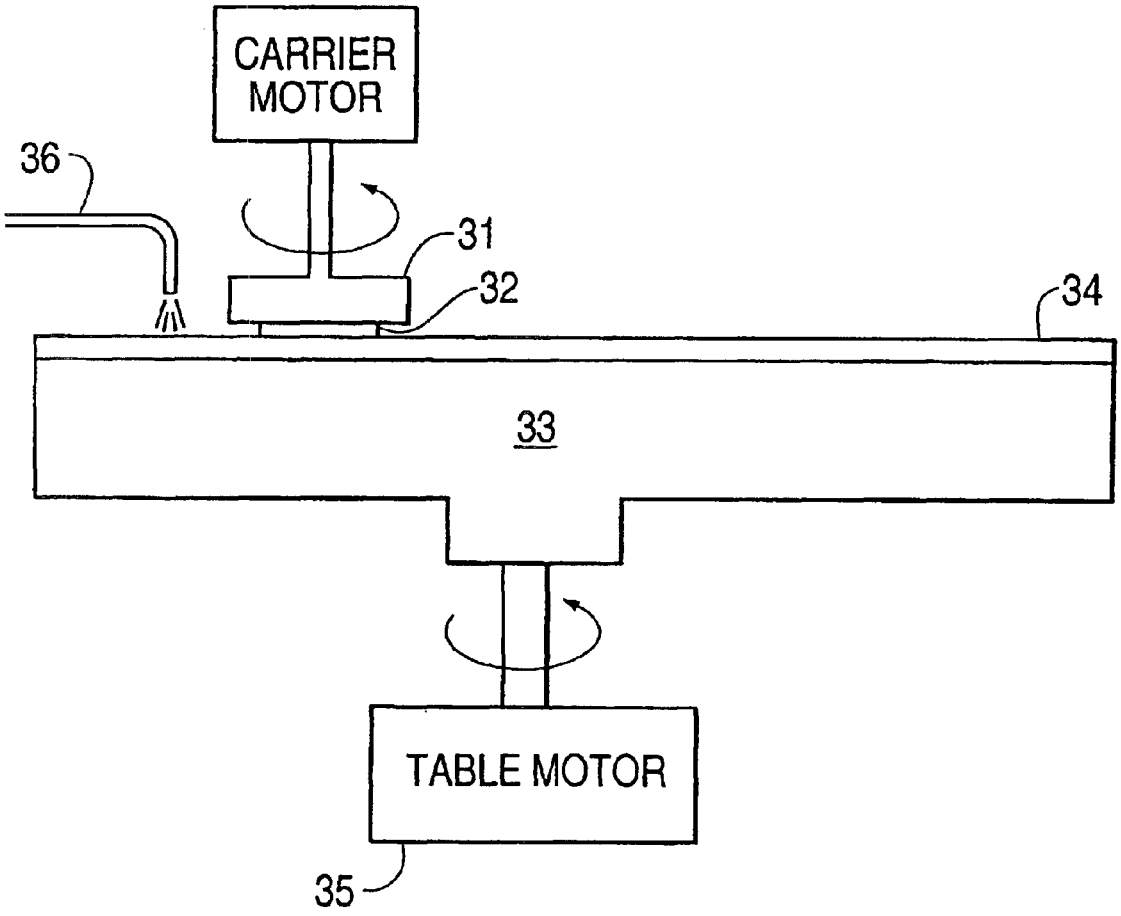
FIG. 2 illustrates a polisher according to one arrangement.

FIG. 2 illustrates a chemical mechanical polisher used for chemical mechanical polishing or planarization (CMP) of semiconductor substrates according to an example arrangement. Other arrangements are also possible. The polisher may include a semiconductor substrate carrier 31 to which a semiconductor substrate 32 is affixed. The substrate carrier 31 may be rotatably coupled to an electric drive motor called a carrier motor 30. A polishing surface 34 may be attached to the top of a table 33. The table 33 may be rotatably coupled to another electric drive motor called a table motor 35. Finally, a spigot 36 may be used to transport a polishing agent, called a slurry, to the polishing surface 34. The slurry may include abrasive particulate matter to aid in mechanically etching the substrate, chemical agents to aid in chemically etching the substrate, or a mixture of both.

The semiconductor substrate 32 may be mounted to the carrier 31 face down so that the top surface of the substrate 32 is pressed against the polishing surface 34 by the carrier 31. The substrate 32 may include a silicon wafer upon which IC components have been formed.

The polishing surface 34 may be fixedly attached to the upper surface of the table 33 and include a polishing pad (not shown in FIG. 2) capable of transporting materials in the slurry to the semiconductor substrate 32. The polishing pad may be roughened to aid in the mechanical polishing of the semiconductor substrate 32. The polisher may also include a computerized user interface for control and access of information related to the polishing process.

To begin the chemical mechanical polishing (CMP) process, the carrier motor 30 may rotate the carrier 31, which in turn rotates the semiconductor substrate 32 against the polishing surface 34. Concurrently, the table motor 35 may rotate the table 33, which in turn rotates the polishing surface 34 against the semiconductor substrate 32. While the motors rotate the carrier 31 and the table 33, the spigot 36 may distribute a slurry onto the polishing surface 34, and the semiconductor substrate 32 is polished.

Additional motors may also be incorporated into the system to add additional axes of rotation between the semiconductor substrate 32 and the polishing surface 34. For example, an off-axis secondary table motor and an off-axis secondary carrier motor may be coupled to the main table motor and the main carrier motor, respectively, to provide two additional axes of rotation. Alternatively, the table motor 35 may be removed so that the table 33 remains stationary, while an additional motor may be coupled to the carrier motor 30 to rotate the carrier motor 30 and the carrier 31 around the table 33.

As discussed above, dishing and erosion are problems in copper CMP processes. Approaches to improve dishing and erosion in copper CMP processes may be based on improving slurry, polisher, and process conditions (i.e., pressure and velocity). Possible process developments include changing the polish speed, pressure, and/or using multiple polish steps with different slurries, each targeting a different material (i.e., Cu, barrier layer or oxide). From the chemical action aspect, improving the slurry chemistry is one approach to control copper rate, selectivity, and therefore dishing and erosion. Another part of the planarization process is the mechanical effects and their synergetic interaction with the slurry. Mechanical factors that impact the CMP process may relate to equipment and wafer scales. Pressure, velocity, pad elasticity and/or overpolish may be adjusted to achieve better uniformity and control for a particular slurry. However, the resulting improvement in dishing and erosion may be limited.

Embodiments of the present invention may provide a technique based on mechanical interactions to reduce dishing and erosion in CMP processes. More specifically, the surface and roughness distribution of a polish pad may be adjusted (or created) according to the design layout and patterns on the wafer to modulate the mechanical contact during the CMP process. By reducing the pad asperity stress transmitted by the polisher, metal line features may experience less polish action than surrounding barrier layers or the ILD during the overpolish process. This may compensate for the larger chemical-mechanical polish rates at these metal line features, thus leading to reduced dishing and erosion.

Embodiments of the present invention may design polish pads for specific products. The design parameters of the polish pads may be adjusted (or created) according to the prescribed layout and feature size distribution, for example. Furthermore, the roughness distribution of the polish pad may help control dishing and erosion independent of the slurry and polisher selection. The design of the polish pad may be combined with other processes in the slurry and the polisher to further improve dishing and erosion.

Figure 3:
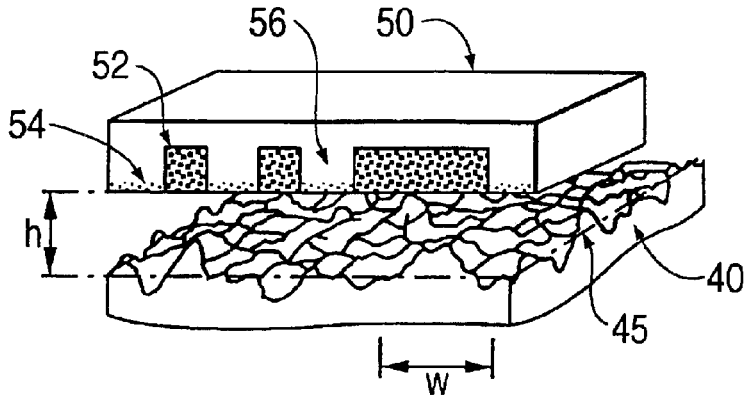
FIG. 3 illustrates patterns on a wafer and a polish pad surface according to one arrangement.

FIG. 3 illustrates a cross sectional view of a portion of a polish pad 40 and a wafer 50 on a $\mu$m-scale according to one arrangement. Other arrangements are also possible. The polish pad 40 may include a substrate having a plurality of peaks and valleys, which hereafter may be called asperities 45. The asperities 45 may relate to roughness of the pad 40. An asperity may be characterized by a height z and a horizontal width w, both varying randomly in ineffective or inefficient polish pads. These inefficient or inefficient pads may have a pad roughness of $\sigma$~20–30 $\mu$m, for example. The randomness of the roughness may be associated with a polyurethane pad forming process (such as curing and subsequent slicing with a blade, and pad surface grooving) and processing (such as polishing and conditioning). As shown, the wafer 50 may include metal line features 52, an ILD 56 and a barrier layer 54 provided on a surface of the wafer 50 over the ILD 56. As one example, the linewidth of the metal line features 52 may be 1–1000 $\mu$. Other linewidths are also possible. During the CMP process, the polish pad 40 may transmit stress to the wafer surface and enable polishing of the metal line features 52, the barrier layer 54 and the ILD 56, simultaneously. Embodiments of the present invention may reduce the stress on the metal line features by polishing the wafer with a polish pad having asperities wider than the dominant metal line features, and with pad surface groove having wider pitches than the wafer features.

Figure 4:
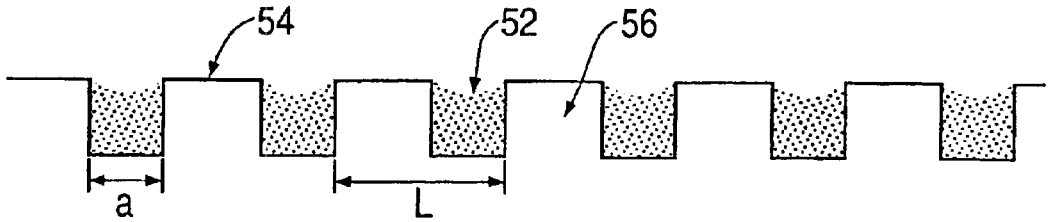
FIG. 4 illustrates patterns on a wafer according to one arrangement.

FIG. 4 illustrates patterns on a wafer according to one arrangement. Other arrangements are also possible. More specifically, FIG. 4 shows a plurality of the metal line features 52 as well as the barrier layer 54 provided over the ILD 56. The barrier layer 54 may have previously been etched off of the metal line features 52. The line width of one of the metal line features is shown as -a- and the line pitch between adjacent metal line features is shown as -L-. FIG. 4 also clearly shows dishing in the metal line features. Erosion within the ILD 56 is not shown.

Embodiments of the present invention relate to the feature-scale analysis of the impact of the pad roughness distribution on the dishing and erosion of metal line features such as those shown in FIGS. 3 and 4. The metal line feature width -a- may be on the same scale as the pad horizontal roughness width -w- and the slurry thickness -h-. The pad surface on the $\mu$m-scale may be affected by the pad conditioning process.

Figure 5:
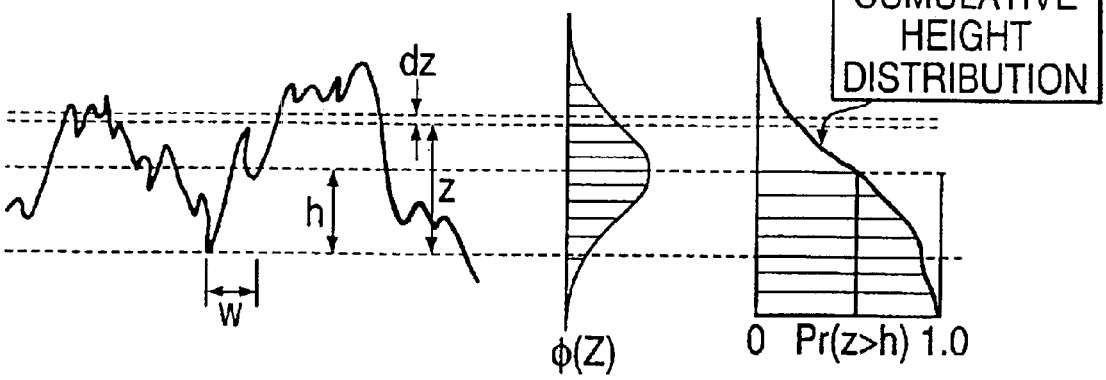
FIG. 5 illustrates a distribution of pad surface roughness according to one arrangement.

FIG. 5 shows a random distribution of pad surface roughness on the feature ($\mu$m) scale according to one arrangement. Other arrangement are also possible. For a random pad surface roughness distribution, the pad surface height and width may be described as Gaussian functions $\phi(z)$. Consequently, the cumulative height distribution $Pr(z>h)=\int\phi(z)dz$ may describe the probability of pad asperity with $z>h$. The probability of pad roughness having a horizontal width -w- smaller than a particular feature size -a- may also be similarly defined. The total probability of a contact between a rough pad surface and a metal line feature of width -a- and slurry thickness -h- is $Pr(w<a|z>h)$. In this example, only the pad surface having a roughness with a width smaller than the feature size -a- makes contact with the metal line features 52.

Based on this principle, the dishing and excessive polishing of the metal line features 52 (compared with the surrounding barrier layer 54 and the ILD 56) may be significantly reduced by decreasing the probability of pad roughness contact with 'recessed' surface features. This principle equally applies to any type of random or regular distribution of pad surface roughness and grooving.

Figure 6:
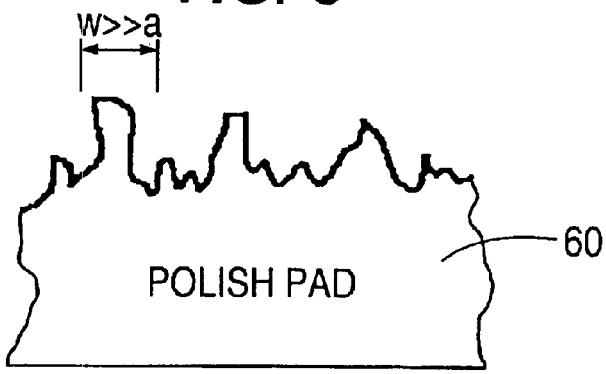
FIG. 6 illustrates a polish pad surface according to an example embodiment of the present invention.
Figure 7:
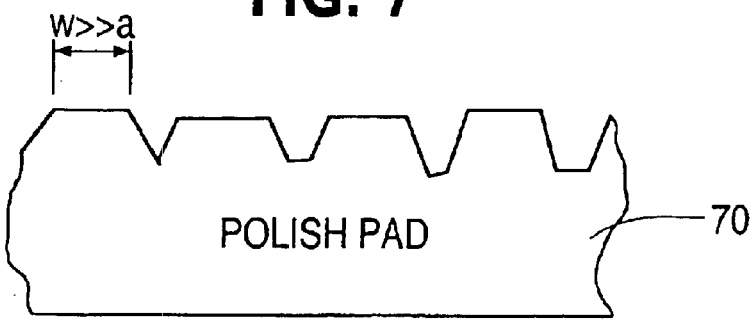
FIG. 7 illustrates a polish pad surface according to an example embodiment of the present invention.

Embodiments of the present invention may include determining the layout and feature size distribution (i.e., line width a) of metal line features (such as the dominant metal line features) for a desired product, and then modifying, altering or creating the polish pad to create an asperity size (roughness w) larger than the metal line feature size -a-. The polish pad may be modified (or created) to have a large pad asperity according to one example embodiment. For example, FIG. 6 shows a polish pad 60 having an asperity size (roughness w) larger than the width -a- of the metal line features. The large asperities dominate the pad surface. The polish pad may also be modified (or created) to have flat asperities according to one example embodiment. For example, FIG. 7 shows a polish pad 70 having flat asperities. In this example, the width of the asperities is larger than the width of the dominant metal line features. Other embodiments and configurations of the polish pad are also within the scope of the present invention.

Larger pad asperities (such as on the polish pad 60) may be manufactured using a polyurethane process having curing (pore structure creation) and slicing steps. This process may involve forming a cylinder of polyurethane and cutting the cylinder into a plurality of polish pads using a cutting blade. The roughness may be selected to be w~100–200 $\mu$m, for example, which results in asperities much wider than the metal line feature size. For example, conditioners using diamond tips may create feature-scale asperity (roughness) on the $\mu$m scale. By eliminating conditioning, small-scale roughness may be avoided. Thus, modifying the conditioner-rotating speed or the conditioning tip size may achieve a similar effect.

Since the pad asperity width -w- may control the probability of the asperity contact, the pad asperity contact may be reduced by choosing w>>a (or $\sigma$>>a). This may be achieved by a manufacturing process during pad conditioning with a conditioner that cuts in horizontal planes to form flat asperities.

FIGS. 8A–8E illustrates a design of a pad conditioner to control feature-scale pad surface roughness according to an example embodiment of the present invention. Other embodiments and configurations are also within the scope of the present invention. This approach may retain the advantages of normal conditioning such as maintaining the polish rate stability. This approach may also reduce the pad roughness below a threshold size determined by the wafer feature layout. Therefore, the feature-scale pad design may be optimized for a particular wafer pattern layout.

FIGS. 8A–8E show the design of a flat asperity pad conditioner that reduces dishing and erosion on the feature scale according to one example embodiment of the present invention. Other embodiments and configurations are also within the scope of the present invention. An amount of "flatness" of the pad surface roughness or asperity may be controlled by an extension of diamond tips from the polish pad conditioner. Alternatively, the "flat asperities" may be created using a horizontally rotating "blade" following the conditioner motion. The size of the pad roughness may be controlled by an offset between the height of the diamond tips. For example, an optical sensor or a mechanical offset may maintain a control accuracy for the offset of several $\mu$m. Additionally, an "add-on" or a separate blade may follow the action of surface regeneration by the diamond tips and remove a controlled amount from the peak of the polish pad to flatten the asperities.

Figure 8A:
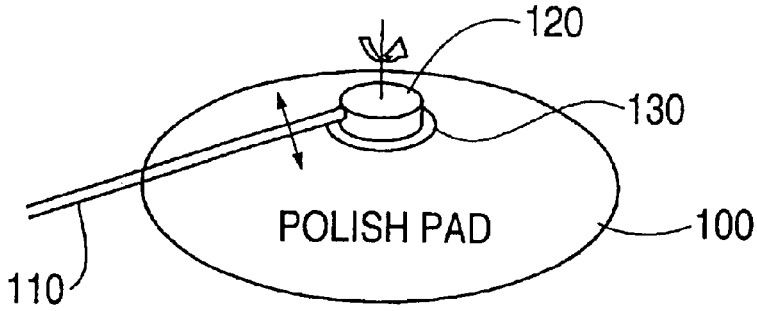
FIGS. 8A–8E illustrates a methodology to form a polish pad according to an example embodiment of the present invention.
Figure 8B:
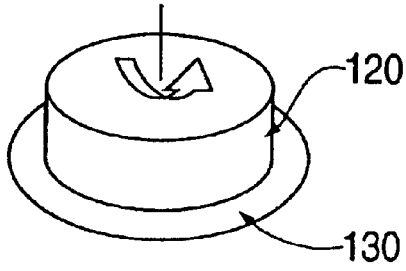
Figure 8C:
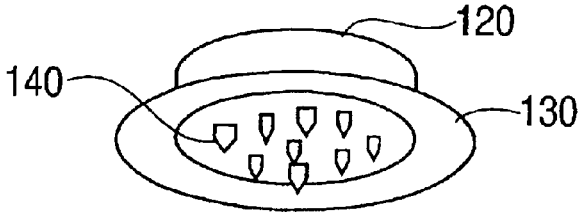
Figure 8D:
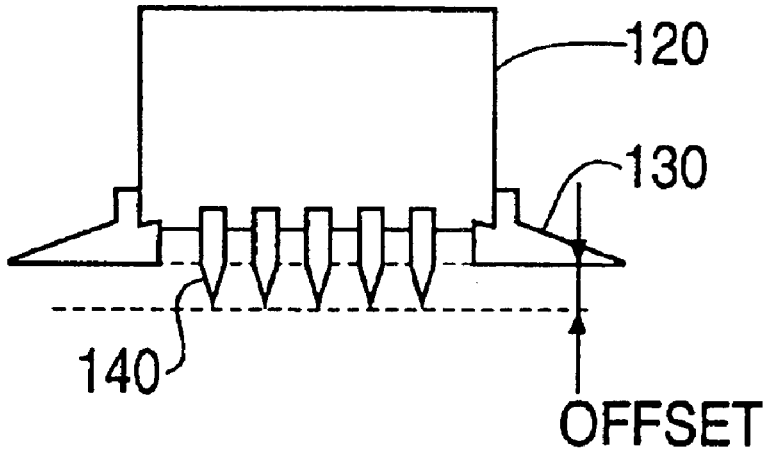
Figure 8E:
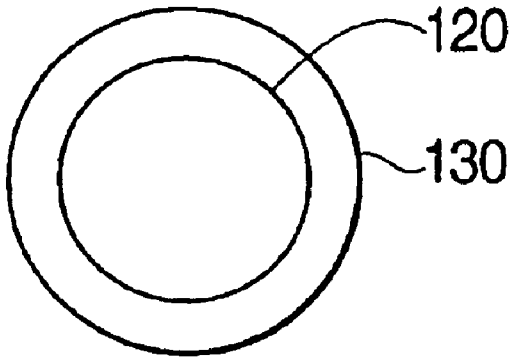

More specifically, FIG. 8A shows a conditioner head assembly that includes a conditioning arm 110, a rotating conditioner head 120 and a rotating blade 130. The conditioning head assembly may be used to provide the flat asperities on a polish pad 100. FIG. 8A also shows the motions of the conditioner relative to the polish pad 100. FIG. 8B is an enlarged view of the rotating conditioner head 120, and the horizontally-cutting blade 130. FIG. 8C is a bottom view of the conditioner with diamond types 140 and the ring-shaped blade 130. FIG. 8D is a cross sectional view of the conditioning head assembly with the pad flattening process controlled by an offset between the cutting plane of the blade 130 and the diamond tips 140. Finally, FIG. 8E is a top view of an individual blade component that may be used together with the conditioner or implemented separately on the conditioning arm 110 following the conditioner motion.

Figure 9:
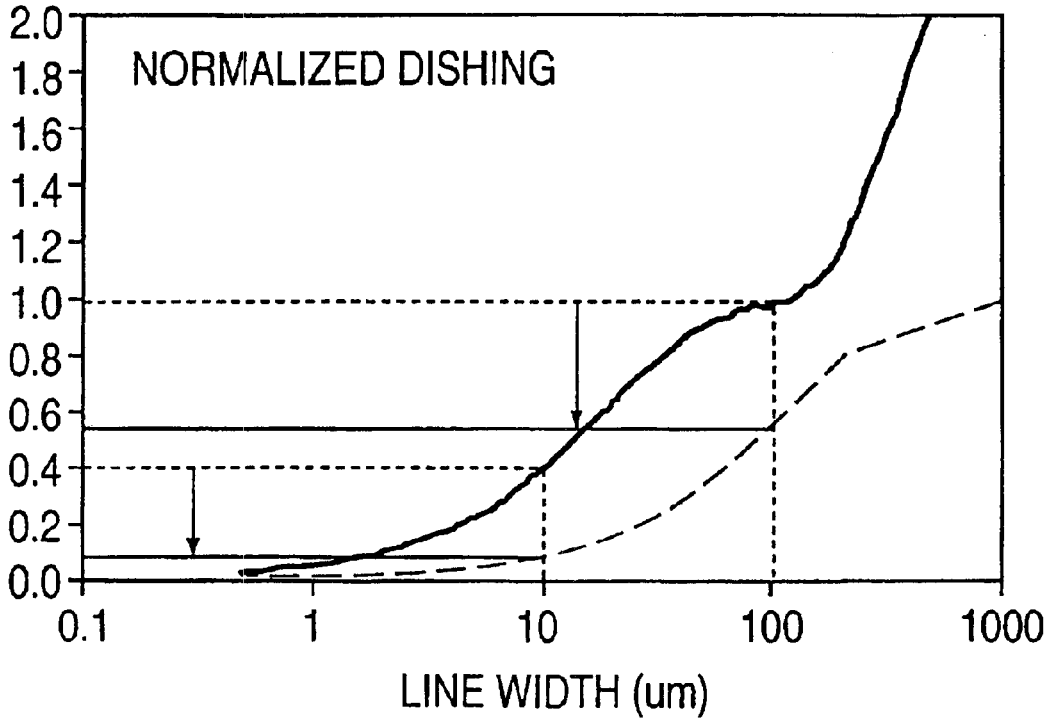
FIG. 9 is a graph showing data of line width versus dishing for two example polish pads.

FIG. 9 is a graph showing line width versus dishing for two example polish pads. The solid line represents a polish pad having a roughness of w=20 $\mu$m and the dashed line represents a polish pad having a roughness of w=120 $\mu$m. As described above, the pad surface roughness acts as a filter for mechanical contact between pad asperities and metal line features on the wafer. Only a small enough asperity may fit into the metal line and exert a polish stress. Dishing may depend largely on the probability of pad asperity contact and therefore on the distribution of roughness on the $\mu$m scale. More specifically, FIG. 9 shows the comparison between dishing simulation for w=120 $\mu$m (i.e., having a larger pad asperity size or flat asperity) and dishing for w=20 $\mu$m. As shown, dishing of a 10 $\mu$m feature is reduced from approximately 0.4 (normalized value) for w=20 $\mu$m to less than 0.1 for w=120 $\mu$m. For wider lines of 100 $\mu$m, the large-asperity-width concept may reduce the worst-case dishing by half (from 1 to about 0.5) without changing slurry or process conditions.

Figure 10:
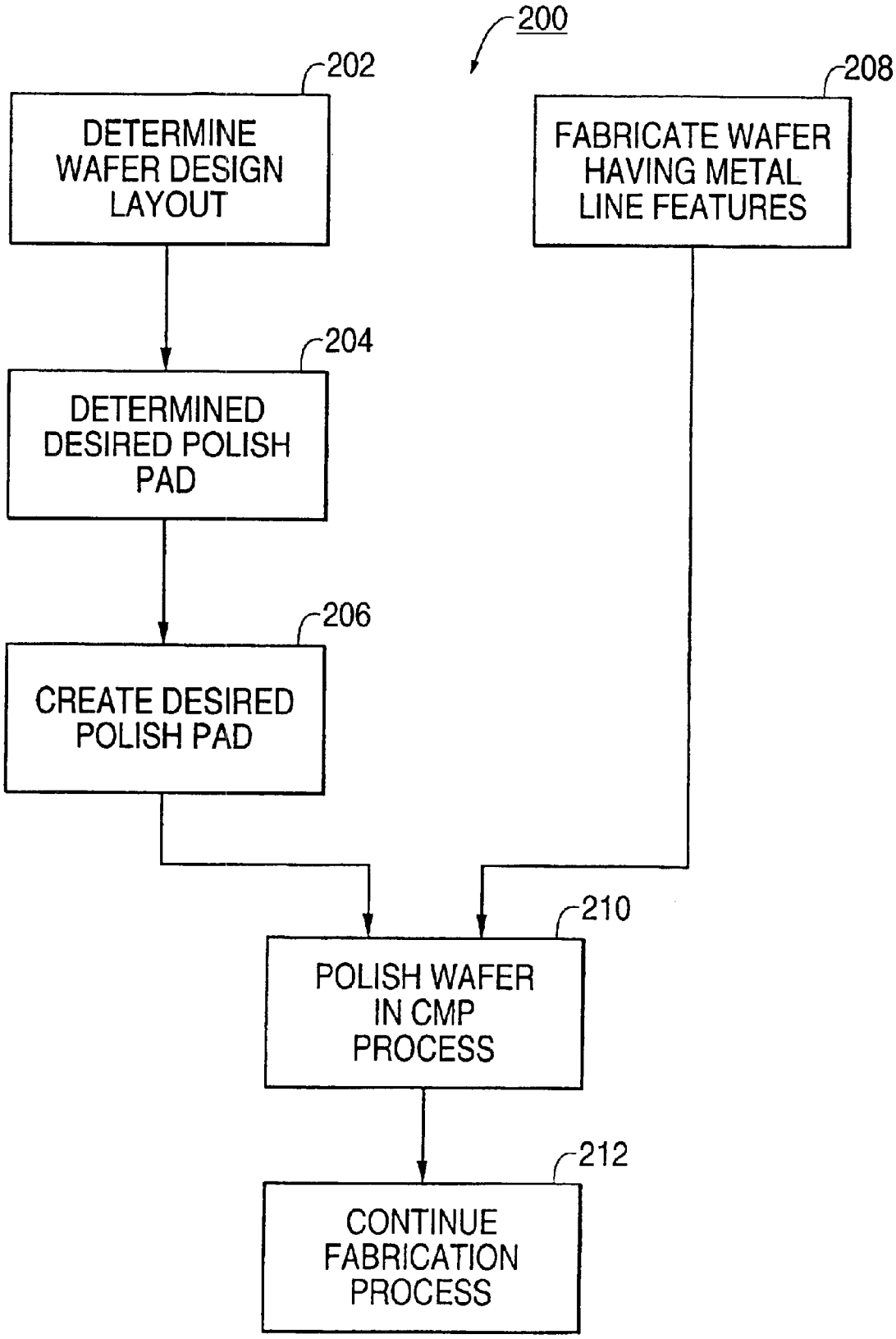
FIG. 10 is a flowchart showing operations of a polishing process according to an example embodiment of the present invention.

FIG. 10 is a flowchart showing a polishing process 200 (such as CMP) according to an example embodiment of the present invention. Other embodiments, operations and orders of operations are also within the scope of the present invention. More specifically, the process 200 may include determining a wafer design layout in block 202. The wafer layout may include the distribution of metal line features including the width and pitch of those features. A desired polish pad may be determined in block 204 based on the design layout. The desired polish pad may have asperities with widths greater than dominant metal line features of the wafer design layout. The desired polish pad may be created, manufactured or altered in block 206. The wafer having the desired design layout (or part of the layout thereof) may be fabricated in block 208. The operations in block 208 may occur prior to, during or subsequent to the operations in blocks 202, 204 and 206. The prepared wafer may correspond to the wafer shown in FIG. 1A, for example. In block 210, the prepared wafer may be polished with the polish pad created in block 206. This may involve using the polisher shown in FIG. 2, but with a specific polish pad for the desired wafer. Additional wafer fabrication processes may occur in block 212 prior to the end of the fabrication process in which the semiconductor device is sold or distributed.

Embodiments of the present invention may be used with copper CMP processes as well as other processes in which selective polish may be used. Embodiments may also extend to other products, processes and to different layouts. A similar methodology may be used to improve planarity of other CMP steps where the material filled in the trenches have a higher polish rates compared to the surrounding materials.

Any reference in this specification to "one embodiment", "an embodiment", "example embodiment", etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc.

Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A method comprising:

determining a distribution of metal line features of a wafer, the distribution including a width of metal line features; and creating a polish pad having a roughness distribution based on the determined distribution of metal line features, wherein creating the polish pad comprises creating asperities on the polish pad having a width greater than the width of metal line features of the wafer.

2. The method of claim 1, wherein creating the polish pad comprises altering an existing polish pad to have the desired roughness distribution.

3. The method of claim 1, wherein creating the polish pad comprises manufacturing the polish pad to have the desired roughness distribution.

4. The method of claim 1, further comprising polishing the wafer with the created polish pad.

5. The method of claim 1, wherein creating the polish pad comprises creating substantially flat asperities on the polish pad.

6. A method comprising:

determining a line width of a plurality of dominant metal line features of a wafer;

providing a polish pad having asperities with a width greater than the line width of the plurality of dominant metal line features of the wafer; and polishing the wafer using the polish pad.

7. The method of claim 6, wherein the asperities are substantially flat.

* * * * *